US012747003B2

(12) United States Patent
Birkemose

(10) Patent No.: US 12,747,003 B2
(45) Date of Patent: Sep. 29, 2026

(54) MARITIME CHUTE FOR MARITIME EVACUATION

(71) Applicant: VIKING LIFE-SAVING EQUIPMENT A/S, Esbjerg (DK)

(72) Inventor: Brian Birkemose, Esbjerg (DK)

(73) Assignee: VIKING LIFE-SAVING EQUIPMENT A/S, Esberjg V (DK)

( * ) Notice: Subject to any disclaimer, the term of this patent is extended or adjusted under 35 U.S.C. 154(b) by 869 days.

(21) Appl. No.: 18/044,489

(22) PCT Filed: Sep. 15, 2021

(86) PCT No.: PCT/EP2021/075354
§ 371 (c)(1),
(2) Date: Mar. 8, 2023

(87) PCT Pub. No.: WO2022/058365
PCT Pub. Date: Mar. 24, 2022

(65) Prior Publication Data

US 2023/0331352 A1 Oct. 19, 2023

(30) Foreign Application Priority Data

Sep. 16, 2020 (EP) ..... 20196342

(51) Int. Cl.
*B63B 27/28* (2006.01)
*B63C 9/22* (2006.01)

(52) U.S. Cl.
CPC ..... *B63B 27/28* (2013.01); *B63C 9/22* (2013.01)

(58) Field of Classification Search
CPC ..... B63B 27/28; B63C 9/22; A62B 1/20
See application file for complete search history.

(56) References Cited

U.S. PATENT DOCUMENTS 1,534,333 A * 4/1925 Sturges ..... A62B 1/20 292/94
4,487,411 A * 12/1984 Ahrens ..... A63G 21/00 472/116

(Continued)

FOREIGN PATENT DOCUMENTS

CN 107693967 A * 2/2018 ..... A62B 1/20
CN 110683003 A 1/2020

(Continued)

OTHER PUBLICATIONS

CN-107693967-A with English Text (Year: 2018).*

(Continued)

*Primary Examiner* — David E Martinez
(74) *Attorney, Agent, or Firm* — Sandberg Phoenix & von Gontard, PC

(57) ABSTRACT

A substantially vertically descending maritime chute for maritime evacuation from a vessel to a floatable unit comprises an inlet section, a plurality of first sections, and a plurality of second sections, which, when connected define an evacuation path through the maritime chute. Each first section and each second section comprises a first upper end and second lower end. Each first section has a first connection means and a second connection means at its first and second ends, respectively. Each second section has a third connection means and a fourth connection means at its first and second ends, respectively. The first connection means is configured to be arranged opposite to and to interact with the fourth connection means to provide a first releasable connection, and the second connection means is configured to be arranged opposite to and to interact with the third connection means to provide a second releasable connection.

19 Claims, 7 Drawing Sheets

(56) References Cited

U.S. PATENT DOCUMENTS

| | | | | |
|---|---|---|---|---|
| 6,102,762 | A * | 8/2000 | Bell | B63B 27/143 182/48 |
| 7,048,092 | B2 * | 5/2006 | Gomes Junior | A62B 1/20 472/117 |
| 7,488,010 | B2 * | 2/2009 | Wellman | F16L 23/032 285/364 |
| 8,382,602 | B2 * | 2/2013 | Rieber | A63G 21/10 472/117 |
| 2012/0100765 | A1 | 4/2012 | Simon Bouhet et al. | |
| 2014/0166396 | A1 * | 6/2014 | Ceeney | A62B 1/20 182/48 |
| 2017/0057081 | A1 * | 3/2017 | Krohne | B25J 11/0085 |
| 2020/0216154 | A1 * | 7/2020 | Gordon | B63C 9/22 |

FOREIGN PATENT DOCUMENTS

| | | | |
|---|---|---|---|
| EP | 0868342 | A1 | 10/1998 |
| GB | 2252283 | A | 8/1992 |

OTHER PUBLICATIONS

International Search Report for PCT/EP2021/075354 mailed Oct. 8, 2021.
Written Opinion for for PCT/EP2021/075354 mailed Oct. 8, 2021.
Extended European Search Report from priority App. EP20196342.8 mailed Mar. 25, 2021.

* cited by examiner

MARITIME CHUTE FOR MARITIME EVACUATION

CROSS-REFERENCE TO RELATED APPLICATIONS

This application is the US National Stage under 35 USC § 371 of International Application No. PCT/EP2021/075354, filed 15 Sep. 2021 which claims priority to European Application No. 2019342.8 filed 16 Sep. 2020, both of which are incorporated herein by reference.

BACKGROUND

The present disclosure relates to a maritime chute for maritime evacuation from a vessel to a floatable unit, the maritime chute is configured to substantially vertical descend. The disclosure also relates to a maritime evacuation system and a method for assembling a maritime chute.

Various solutions have been presented in the past for evacuating people from ships and oil rigs by means of a chute having a substantially vertical descent. The applicant has marketed maritime evacuation systems configured for evacuation where most of the descent is practically vertical. Such systems comprise a chute having a succession of linked, rigid and spaced apart steel rings which are connected by elastic cords attached to the rings. The elastic cords and rings are arranged to allow longitudinal stretching as well as contraction. The chute also has an elastic stocking-like device arranged and held inside the succession of rings. The stocking-like device is adapted to slow a rate of descent of a falling person who is being evacuated through the stocking-like device. Each elastic cord extends vertically from the top to the bottom of the chute when the chute is in use and is launched from a high evacuation position and allowed to extend freely downwards. The long elastic cords are attached to each ring with a bracket and extend in parallel, vertical courses of direction, each being parallel to a longitudinal axis of the chute. Normally the lower end of the chute is anchored at a floating platform or life raft. Due to the elastic cords, the chute is able to stretch as well as contract to compensate for varying height caused by waves. This allows people to escape through the chute even when the length of the chute changes.

Since the known chute systems for maritime evacuation have a rather complex design for fulfilling requirements, for instance, for varying heights, security, etc. they are difficult to manufacture and subsequently difficult and cumbersome to perform service and maintenance on. Hence, there is a need for a simpler design of the maritime chute without jeopardizing safety requirements.

SUMMARY

It is an object to wholly or partly overcome the above disadvantages and drawbacks of the prior art. More specifically, it is an object to provide an improved maritime chute having a design facilitating assembling, disassembling as well as service and maintenance.

The above objects, together with numerous other objects, advantages and features, which will become evident from the below description, are accomplished by providing a maritime chute for maritime evacuation from a vessel to a floatable unit, wherein the maritime chute is configured to substantially vertical descend. The maritime chute comprises:

an inlet section, a plurality of first sections AB, each first section AB comprising a first upper AB end and second lower AB end, a plurality of second sections BA, each second section BA comprising a first upper BA end and a second lower BA end, wherein in each first section, each first upper AB end comprises a first connection means and each second lower AB end comprises a second connection means, in each second section, each first upper BA end comprises a third connection means and each second lower BA end comprises a fourth connection means, the first connection means is configured to be arranged opposite to and to interact with the fourth connection means for providing a first releasable connection, and the second connection means is configured to be arranged opposite to and to interact with the third connection means for providing a second releasable connection, the sections when connected define an evacuation path to lead a person down through the maritime chute during the descent.

Furthermore, the plurality of first sections AB may be different from the plurality of second sections BA.

Moreover, the first connection means may be different from the second connection means so that a first section AB is not able to be connected with another first section AB.

Also, the third connection means may be different than the fourth connection means so that a second section BA is not able to be connected with another second section BA.

In addition, the first connection means may be different compared to the third connection means, and the second connection means may be different compared to the fourth connection means, so that the first connection means interacts with the fourth connection means only, and the second connection means interacts with the third connection means only.

Furthermore, in each first section, each first upper AB end may comprise a first indication and each second lower AB end comprises a second indication, in each second section, each first upper BA end may comprise a third indication and each second lower BA end comprises a fourth indication, the first indication may be configured to be arranged opposite with the fourth indication for ensuring that the first upper AB end is positioned correctly in relation to the second lower BA end before connecting the first connection means with the fourth connection means, and the second indication may be configured to be arranged opposite with the third indication for ensuring that the first lower AB end is positioned correctly in relation to the second upper BA end before connecting the second connection means with the third connection means.

The first indication and the second indication may be different for assisting in that two first sections AB are not unintendedly attempted to be connected.

The third indication and the fourth indication may be different for assisting in that two second sections BA are not unintendedly attempted to be connected.

Moreover, the first sections AB and the second sections BA may be substantially circular.

Also, the first sections AB may have a first outer circumference and the second sections BA may have a second outer circumference. The first outer circumference being substantially identically with the second outer circumference.

In addition, each connection means may extend around the outer circumference of the first sections AB and the second sections BA, respectively.

In accordance with an aspect of the maritime chute, two adjacent connection means may be configured to interact with each other after being positioned in relation to each other.

Furthermore, each connection means may comprise a plurality of tunnel segments, each tunnel segment being arranged with a distance to an adjacent tunnel segment thereby providing a space between them wherein a tunnel segment of another connection means is configured to be inserted so that all tunnel segments of two adjacent connection means together defines a continuously extending tunnel in which a locking member is arranged for locking two adjacent connection means to each other.

Moreover, the tunnel segments of two adjacent connection means may be arranged so that they only can be inserted in relation to each other when two adjacent sections are aligned in relation to each other.

Also, the distances between the tunnel segments may vary along the circumference of the sections.

The tunnel segments may have a segment extension extending along the circumference of the sections, the segment extensions may vary along the circumference of the sections.

Additionally, the locking member may be circular being substantially the same size as the outer circumferences of the first and second sections.

Also, the locking member may comprise two or more ring parts, each end of the ring parts comprises locking means so that two ring parts can be locked to each other providing a continuously extending ring.

In addition, the locking means may be apertures and bolts to be arranged in the apertures.

Advantageously, the locking member may be made of metal, composite, reinforced glass-fiber or carbon or a combination thereof.

The locking member or ring parts may be flat when seen in a cross-sectional view.

Furthermore, the connection means may be ring-shaped extending along the outer circumferences of the first sections AB and the second sections BA, respectively.

Also, each ring-shaped connection means may have one or more apertures.

Moreover, two adjacent ring-shaped connection means may be positioned so that the one or more apertures is/are arranged opposing each other whereby one or more locking means can extend through the apertures and lock two adjacent ring-shaped connection means to each other.

In an embodiment of the maritime chute, the evacuation path may be a helix slide extending continuously down through the sections.

In addition, each first section AB may have a first helix slide part and each second section BA may have a second helix slide part.

Additionally, the first helix part may have a first helix part end and a second helix part end, the second helix part may have third helix part end and a fourth helix part end.

Furthermore, the first helix part end may be configured to be connected with the fourth helix part end and the second helix part end may be configured to be connected with the third helix part end, and vice versa, for providing a continuously extending helix slide down through the sections of the cute.

The helix slide parts may be connected by means of zippers.

In an embodiment, the first helix part and the second helix part may overlap so that a smooth slide path is obtained.

Each slide part may be a double layer configuration.

Moreover, the chute may have a center axis. A first center line is arranged extending down through the chute along the central axis.

Also, a second center line may be arranged along the first center line for redundancy.

Advantageously, each section may have an outer liner. The outer liner may comprise a closable opening extending along the section. The closable opening may be closable by means of a zipper.

The helix parts may be connected with an inside of the outer liner.

Furthermore, the chute may have a diameter being between 1 to 2 meters and each section has a section height being between 1 to 1.75 meters.

Moreover, a plurality of outer lines may be arranged around the circumference of the sections outside the outer liner, the outer lines extending along the extension of the chute on the outside of the chute and each outer line is connected with the locking members.

In addition, a plurality of elastic lines may be arranged around the circumference of the sections outside the outer liner, the outer lines extending along the extension of the chute on the outside of the chute and each outer line is connected with the locking members.

A maritime evacuation system is also disclosed comprising a vessel or offshore facility, a maritime chute as described above, and an inflatable life raft or inflatable survival craft or rescue boat.

Furthermore, the maritime evacuation system may comprise a chute dispenser to be arranged on the vessel or offshore facility, the chute dispenser being configured to house the chute during storage and to dispense the chute during evacuation.

Lastly, a method is disclosed for assembling a maritime chute as described above, comprising:

providing an inlet section, providing a first section AB comprising a first upper AB end and second lower AB end, connecting the first upper AB end to the inlet section, providing a second section BA comprising a first upper BA end and a second lower BA end, aligning the second connection means of the second lower AB end of the first section AB with the third connection means of the first upper BA end of the second section, connecting the second connection means with the third connection means, providing an additional first section AB, aligning the fourth connection means of the second lower BA end of the second section BA with the first connection means of the first upper AB end of the additional first section AB, connecting the fourth connection means with the first connection means, providing an additional second section BA, aligning the second connection means of the second lower AB end of the additional first section AB with the third connection means of the first upper BA end of the additional second section, connecting the second connection means with the third connection means.

Furthermore, the steps of providing additional first sections and second sections, aligning the connection means of the sections and connecting the connection means with each other are continued until a predetermined height of the maritime chute is reached.

DESCRIPTION OF THE FIGURES

The claimed invention and its many advantages will be described in more detail below with reference to the accompanying schematic drawings, which for the purpose of illustration show some non-limiting embodiments and in which

All the figures are highly schematic and not necessarily to scale, and they show only those parts which are necessary in order to elucidate the invention, other parts being omitted or merely suggested.

DETAILED DESCRIPTION

Figure 1:
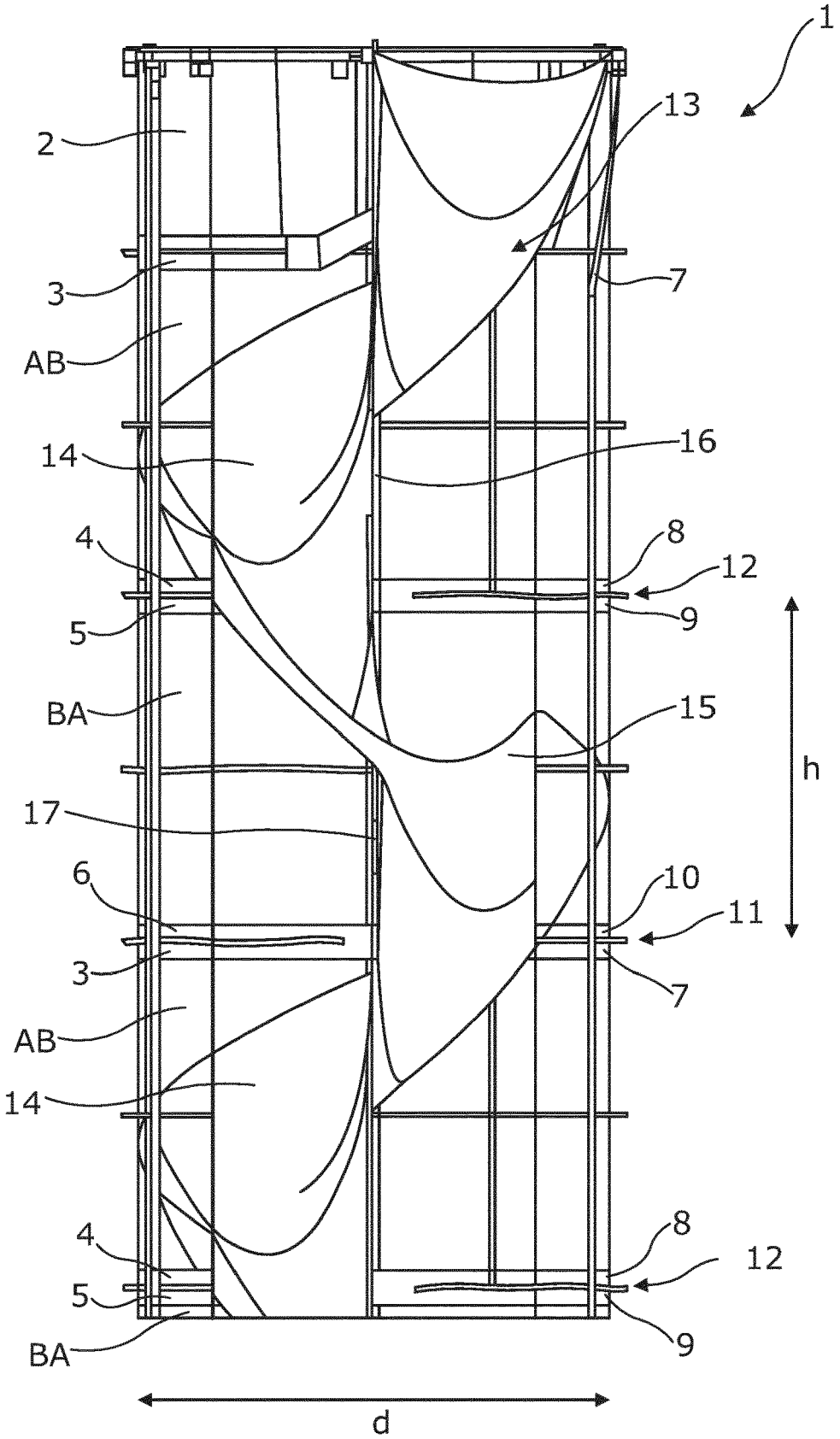
FIG. 1 shows a maritime chute.

FIG. 1 shows a maritime chute 1 for maritime evacuation from a vessel to a floatable unit, the maritime chute 1 is configured to substantially vertical descend, comprising an inlet section 2. The inlet section 2 ensures that the persons to be evacuated are properly introduced into the maritime chute 1.

The maritime chute 1 comprises a plurality of first sections AB, each first section AB comprising a first upper AB end 3 and second lower AB end 4, and a plurality of second sections BA, each second section BA comprising a first upper BA end 5 and a second lower BA end 6.

According to the inventive idea each first upper AB end 3 comprises a first connection means 7 and each second lower AB end 4 comprises a second connection means 8, and each first upper BA end 5 comprises a third connection means 9 and each second lower BA end 6 comprises a fourth connection means 10. The first connection means 7 is configured to be arranged opposite to and to interact with the fourth connection 10 means for providing a first releasable connection 11, and the second connection means 8 is configured to be arranged opposite to and to interact with the third connection means 9 for providing a second releasable connection 12.

The maritime chute 1 comprises three different sections namely, the inlet section 2, the first section AB and the second section BA. Only one inlet section 2 is provided and a plurality of first sections AB and second sections BA are provided depending on an intended height of the maritime chute. The first sections AB and the second sections BA are alternatingly arranged. Also, the first sections AB and the second sections BA are different.

In addition, the first connection means are different than the second connection means meaning that a first section AB is not able to be connected with another first section AB without losing its function. The same applies for third connection means and fourth connection means ensuring that two second sections BA are unable to be connected.

Also, the first connection means may be different compared to the third connection means, and the second connection means may be different compared to the fourth connection means, so that the first connection means interacts with the fourth connection means only, and the second connection means interacts with the third connection means only.

Hereby, a Poka Yoke design of the maritime chute is obtained ensuring that no mistakes in assembling the maritime chute is possible. Furthermore, a maritime chute is obtained which is easy to assemble and disassemble, where service is facilitated, and section replacement may be done without disrupting rest of the chute.

The inlet section 2 also comprises connection means in one inlet end (not shown). The connection means is configured to be arranged opposite to and to interact with the first connection means 7 of a first section AB is same manner as described above.

The sections 2, AB, BA when connected define an evacuation path 13 to lead a person down through the maritime chute 1 during the descent. The evacuation path 13 may have many different designs, however in the present embodiment the evacuation path 13 is a helix slide 13 extending continuously down through the sections 2, AB, BA.

In the present embodiment each first section AB has a first helix slide part 14 and each second section BA has second helix slide part 15. The first helix slide part 14 has a first helix part end and a second helix part end, the second helix slide part 15 has third helix part end and a fourth helix part end. The first helix part end is configured to the connected with the fourth helix part end and the second helix part end is configured to be connected with the third helix part end, and vice versa, for providing a continuously extending helix slide 13 down through the sections 2, AB, BA as shown in FIG. 1.

In one embodiment the helix slide parts 14, 15 are connected by means of zippers or similar means ensuring easy assembling and disassembling.

Furthermore, the first helix part 14 and the second helix part 15 overlap each other so that a smooth slide path is obtained, and it is ensured that the person sliding on the helix slide not is caught by any protruding parts or elements during the descent.

Moreover, each slide part 14, 15 may have a double layer configuration.

The maritime chute 1 has a center axis 16 with a first center line 17 arranged extending down through the maritime chute 1 along the central axis 16. In addition, a second center line may be arranged along the first center line for redundancy. The first and second center lines may be webbings, ropes or similar.

The first sections AB and the second sections BA may be substantially circular. Furthermore, the maritime chute may have a diameter d being between 1 to 2 meters and each section may have a section height h being between 1 to 1.75 meters.

Figure 2:
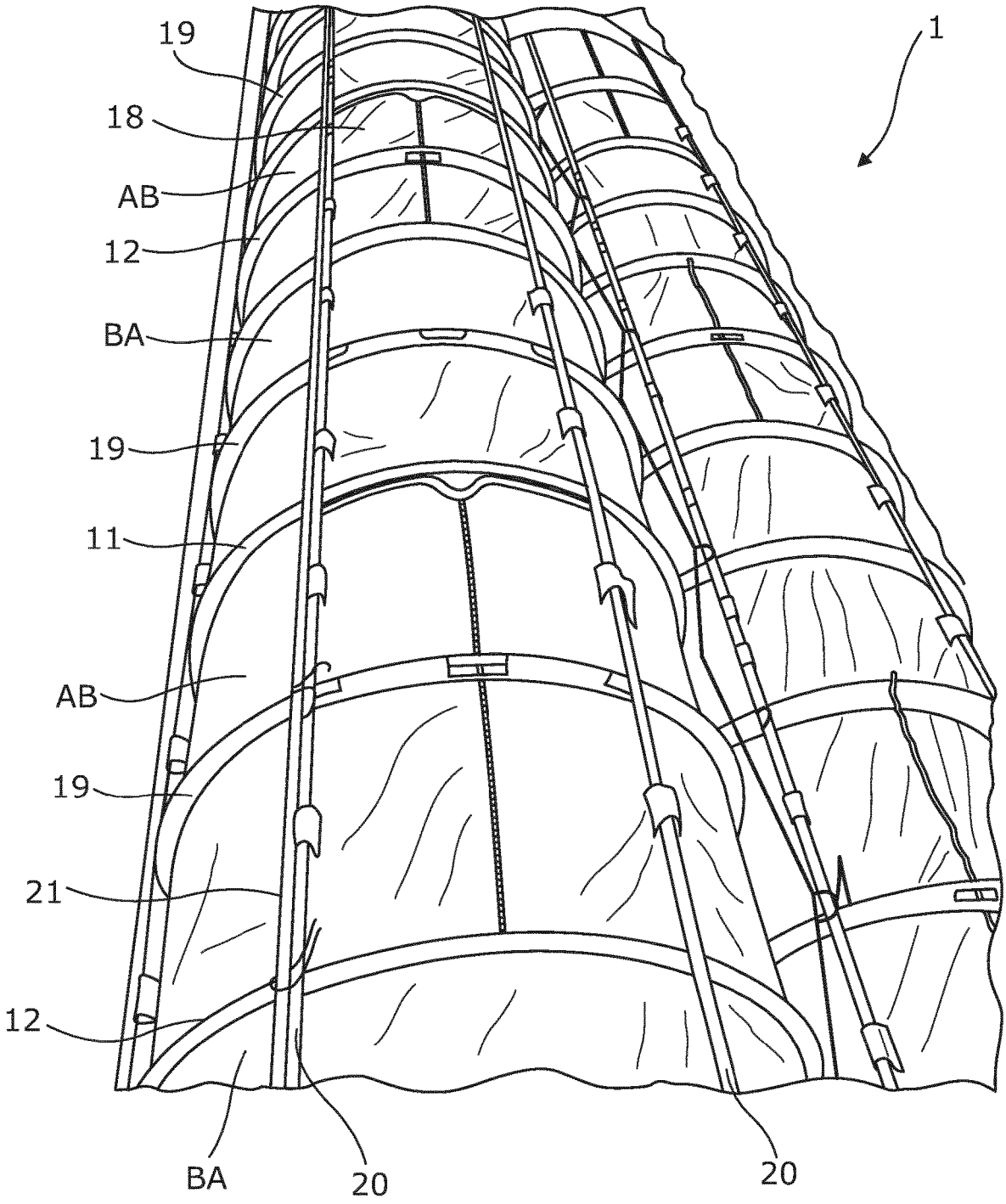
FIG. 2 shows a part of a double maritime chute.

In FIG. 2, a double maritime chute 1 is partly shown seen from the outside. By double is meant that two maritime chutes are arranged next to each other. In other embodiments a plurality of maritime chutes may be arranged next to each other depending on the capacity of the evacuation system.

In the same manner as described above the maritime chute 1 comprises a plurality of first sections AB and a plurality of second sections BA connected with each other by the releasable connections 11, 12, respectively.

The connections 11, 12 will be further described below in relation to FIGS. 3 to 6. As may be seen in FIG. 2 the maritime chute 1 has a plurality of rings 19 arranged along the extension of the maritime chute 1 with a predetermined distance between them. Some of these rings 19 are used as locking members between two adjacent connection means which will be described further below, however additional rings may be arranged between two ends of a first section or a second section for providing stability and rigidity the maritime chute 1. The rings 19 ensure that the maritime chute will not collapse inwardly when exerted for load on the slide path.

The rings are arranged outside an outer liner 18 of each section AB, BA.

In the present embodiment the evacuation path is a helix slide 13. As mentioned above the helix slide comprises a plurality of helix slide parts. The helix slide parts are connected with an inside face of the outer liner 18 at one side of the helix slide part. The helix slide parts may be sewn to the inside face along the entire extension or it may be connected to the inside face at predetermined positions.

At the opposite side of the helix slide parts, the helix slide parts are not directly connected along the center axis whereby they may hang in a vertical direction. The helix slide parts are connected at the top. The vertical extensions of the helix slide parts are then stretched with the opposite side of helix slide parts being connected with the inside face of the outer liner. Since the helix slide parts rotate, the vertical extensions will be maintained in position at the center axis so that a slide path is obtained on which the person to be evacuated may slide on during the descent through the maritime chute.

Hereby is obtained that if the height between the vessel and the life raft or survival craft is lower than the length of the maritime chute some of the sections will be positioned on top of each other at the life raft. The distance between the side of the helix slide part being connected to the inside face of the outer liner and the side of the helix slide part being at the center axis will be lower and thereby the vertical extensions will not be stretched. Hereby, the side of the helix slide part being at the center axis will hang as a curtain along the inside face of the outer liner so that a person descending through the maritime chute will be able to leave the maritime chute at this position through the outlet of the maritime chute. Hence, by this configuration the outlet of the maritime chute may be provided in any position of the maritime chute independent of a varying extension length in an evacuation situation.

Furthermore, a plurality of outer lines 20 is arranged around the circumference of the sections outside the outer liner 18, the outer lines 20 are extending along the extension of the maritime chute 1 on the outside of the maritime chute and each outer line is connected with the rings 19. The outer lines 20 ensure that the load exerted on the maritime chute 1 is transferred to the outer lines 20 from the rings 19 instead of the loads being absorbed by the outer liner 18.

Also, a plurality of elastic lines 21 is arranged around the circumference of the sections outside the outer liner 18. The elastic lines 21 extend along the extension of the maritime chute 1 on the outside of the maritime chute 1 and each elastic line 21 is connected with the rings. The elastic lines 21 provide flexibility to the height of the maritime chute 1.

As mentioned above, the maritime chute 1 is substantially circular. Each connection means may extend around the outer circumference of the first sections AB and the second sections BA, respectively.

Figure 3:
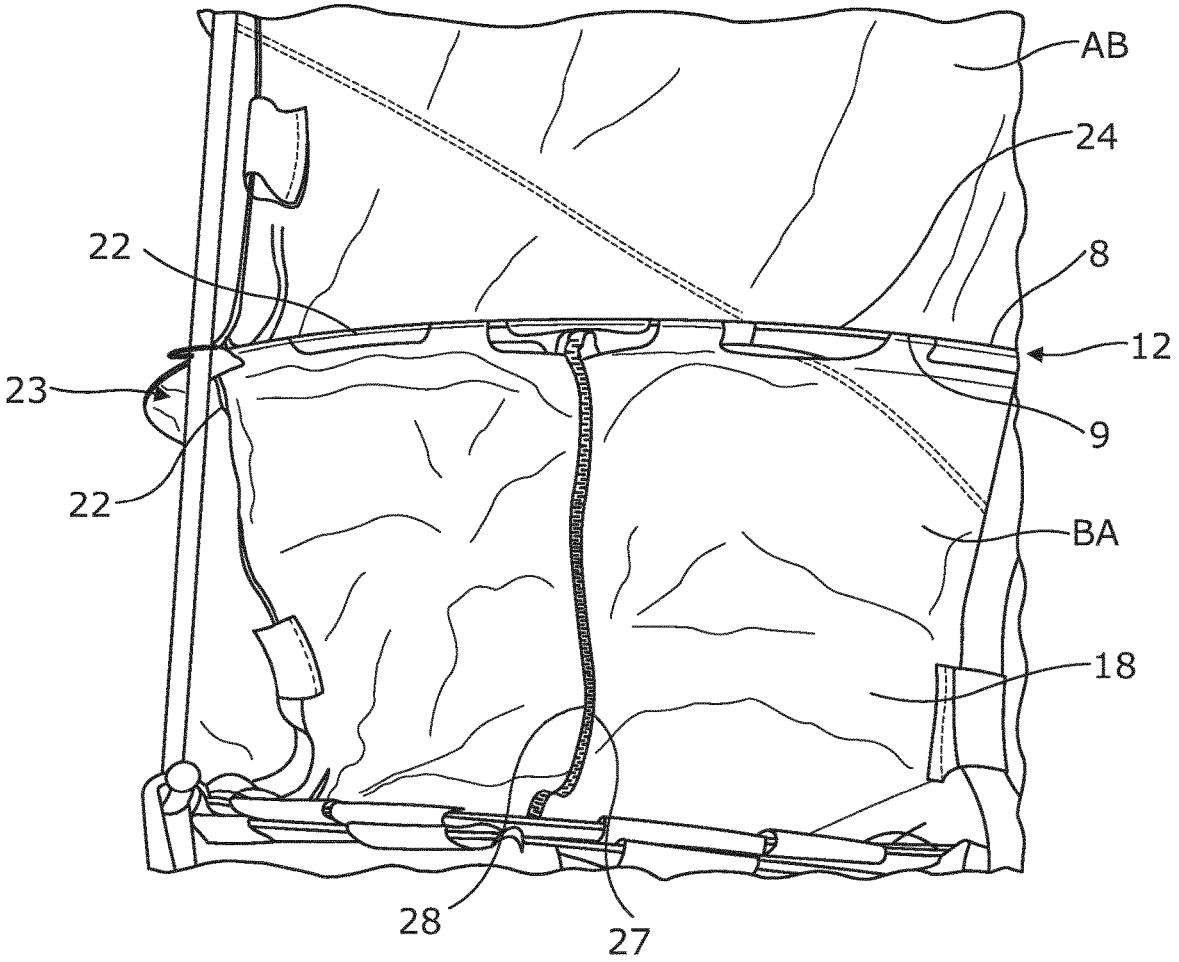
FIGS. 3 and 4 show connection parts releasably connecting two adjacent sections.
Figure 4:
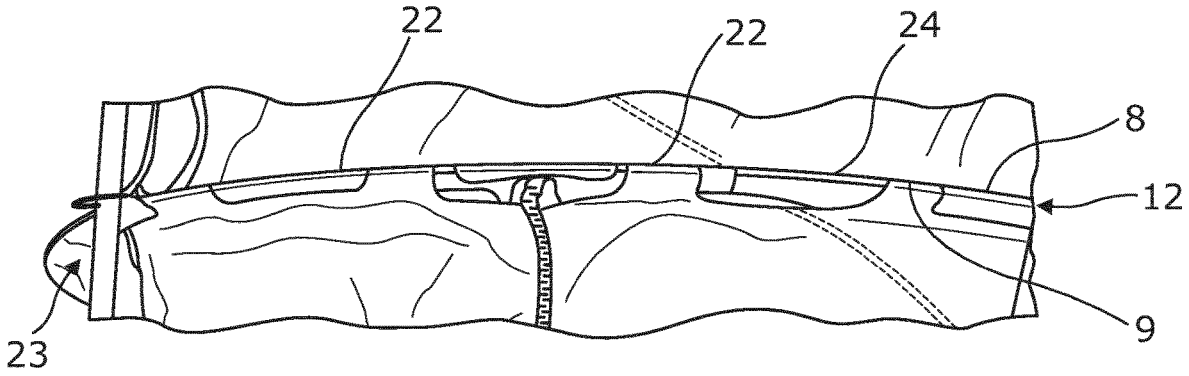

In an embodiment of the maritime chute as shown in FIGS. 3 and 4 two adjacent connection means 8, 9 are configured to interact with each other after being positioned in relation to each other.

In the present embodiment each connection means 8, 9 comprises a plurality of tunnel segments 22, each tunnel segment 22 being arranged with a distance to an adjacent tunnel segment thereby providing a space between them wherein a tunnel segment of another connection means is configured to be inserted so that all tunnel segments of two adjacent connection means together defines a continuously extending tunnel 23 in which a locking member 24 is arranged for locking two adjacent connection means 8, 9 to each other.

The tunnel segments 22 of two adjacent connection means are arranged so that they only can be inserted in relation to each other when two adjacent sections are aligned in relation to each other.

Also, the distances between the tunnel segments may vary along the circumference of the sections.

The tunnel segments may have a segment extension extending along the circumference of the sections, the segment extensions may vary along the circumference of the sections.

The locking member 24 is circular being substantially the same size as the outer circumferences. The locking members 24 may have same configuration as the rings 19 described in connection with FIG. 2.

The locking member 24 may comprise two or more ring parts, each end of the ring parts comprises locking means so that two ring parts can be locked to each other providing a continuously extending ring. In a preferred embodiment the locking member comprises three ring parts which facilitate feeding the ring parts through the tunnel segments.

Figure 5:
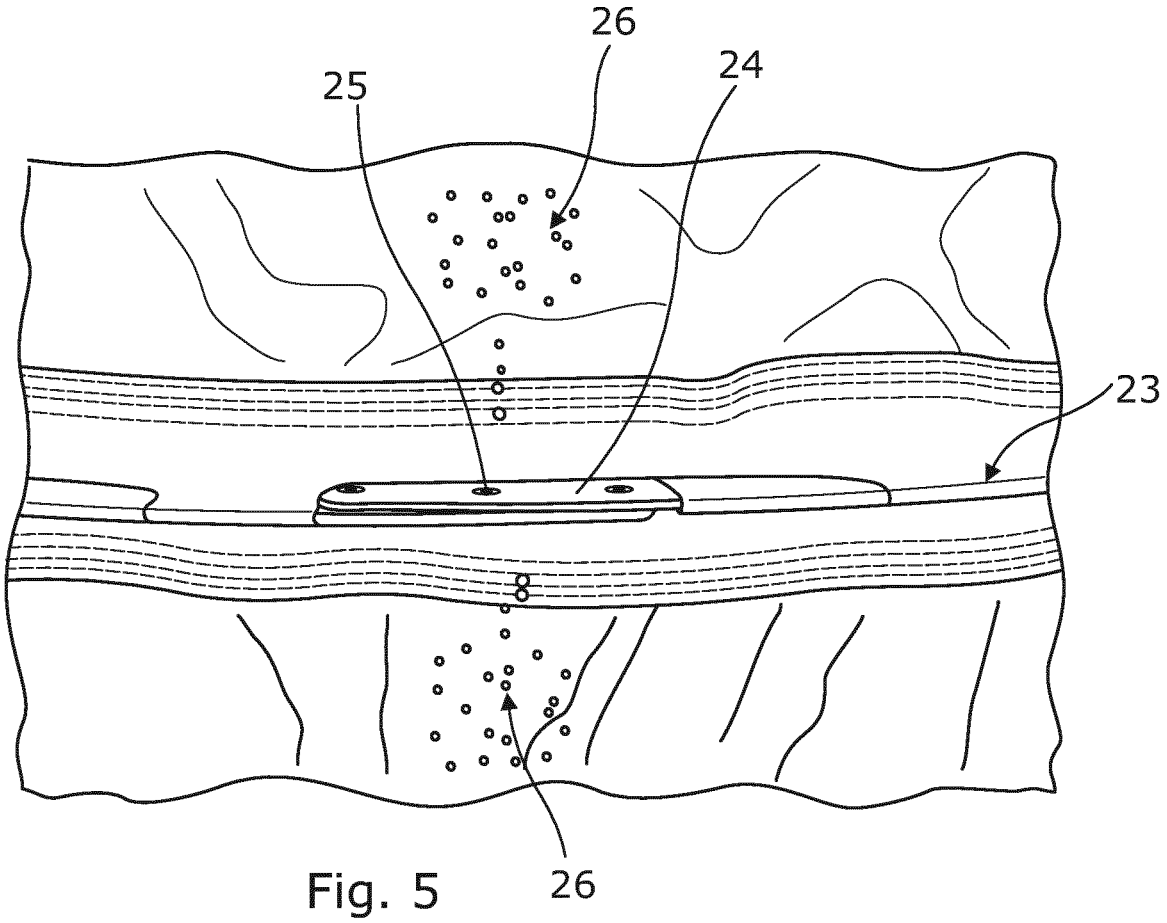
FIG. 5 shows a part of the locking member, FIG. 6 schematically shows an embodiment of two adjacent connection means being arranged opposite each other.

In FIG. 5 the locking means 25 are apertures and bolts to be arranged in the apertures. Furthermore, the locking members 24 and rings 19 may be made of metal, composite, reinforced glass-fiber or carbon or a combination thereof. The locking members and rings may be flat when seen in a cross-sectional view as seen in FIG. 5.

Furthermore, each first upper AB end may comprise a first indication and each second lower AB end comprises a second indication, each first upper BA end may comprise a third indication and each second lower BA end comprises a fourth indication, the first indication is configured to be arranged opposite with the fourth indication for ensuring that the first upper AB end is positioned correctly in relation to the second lower BA end before connecting the first connection means with the fourth connection means, and the second indication is configured to be arranged opposite with the third indication for ensuring that the first lower AB end is positioned correctly in relation to the second upper BA end before connecting the second connection means with the third connection means.

In FIG. 5 indications 26 are shown arranged opposite each other.

Figure 6:
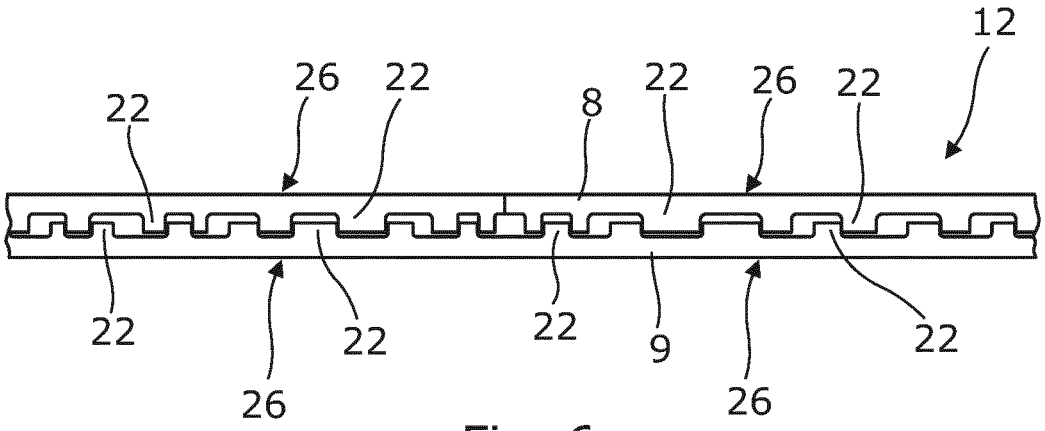
Figure 7:
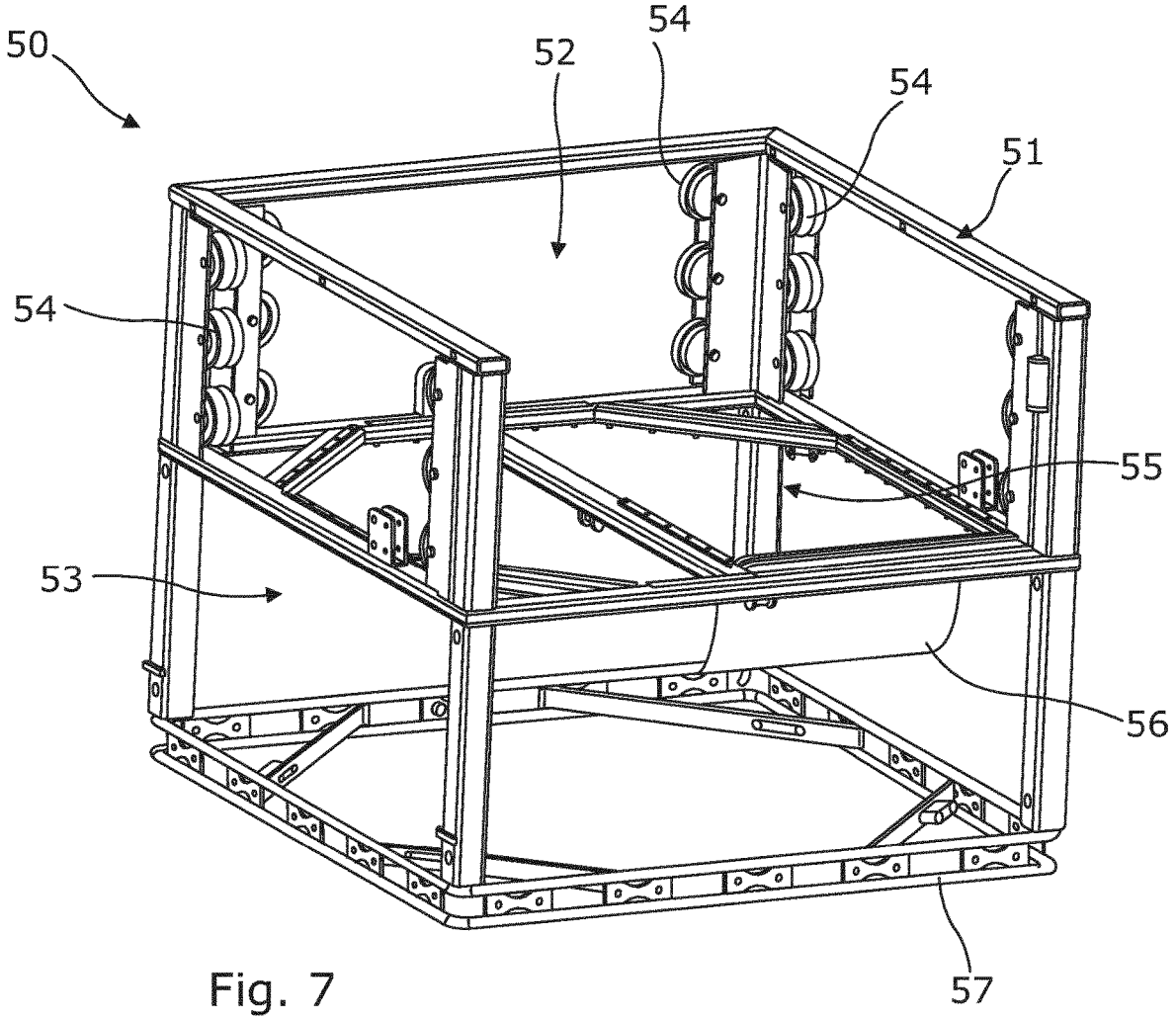
FIGS. 7-11 show an embodiment of a chute dispenser.

In FIG. 6 a schematic view of a releasable connection 12 is shown. The connection means 8 comprises a plurality of tunnel segments 22, each tunnel segment 22 being arranged with a distance to an adjacent tunnel segment thereby providing a space between them wherein a tunnel segment 22 of another connection means 9 is configured to be inserted so that all tunnel segments of two adjacent connection means together defines a continuously extending tunnel in which a locking member (not shown) is arranged for locking two adjacent connection means 8, 9 to each other. As shown in FIG. 6 the tunnel segments 22 of two adjacent connection means 8, 9 are arranged so that they only can be inserted in relation to each other when two adjacent sections are aligned in relation to each other. As mentioned above indications are arranged for facilitating aligning two opposite connection means in relation to each other. In FIG. 6 the connection means 8 has several indications 26 depicted as B1 and the connection means 9 has several indications 26 depicted as B2. When assembling connection means 8 with connection means 9 B1 and B2 are aligned whereby it is ensured that the tunnel segments 22 of each connection means together may define a continuous tunnel. As may be seen in FIG. 6 if the indications B1 and B2 are not arranged opposite each other the different tunnel segments will be offset in relation to each other and thereby the tunnel will not be provided.

In FIG. 3 the outer liner 18 comprises a closable opening 27 extending from along the section. In the present embodiment the closable opening 27 is closable by means of a zipper 28. Each section AB, BA has a closable opening 27 arranged in the outer liner 18.

Furthermore, a chute dispenser 50 may be arranged on the vessel or offshore facility, the chute dispenser 50 being configured to house the maritime chute during storage and to dispense the maritime chute during evacuation. In FIGS. 7 to 11 an embodiment of the chute dispenser 50 is shown.

The chute dispenser 50 comprises a frame 51 to be arranged on the vessel or offshore facility. The frame 51 comprises a first room 52 and a second room 53. The maritime chute (not shown) is arranged in the second room 53 during storage. The first room comprises a number of turning points 54. The number of turning points are configured to guide the elastic lines (not shown). The elastic lines have the function of maintaining the maritime chute in position and at the right tension independent of varying heights between the chute dispenser and the water surface caused by movements of the vessel in the sea and/or wave heights. The first room furthermore has an entrance 55 for the persons to be evacuated. In addition, a guide 56 is arranged at the entrance 55 for assisting the persons to be evacuated to enter into the maritime chute.

Figure 8:
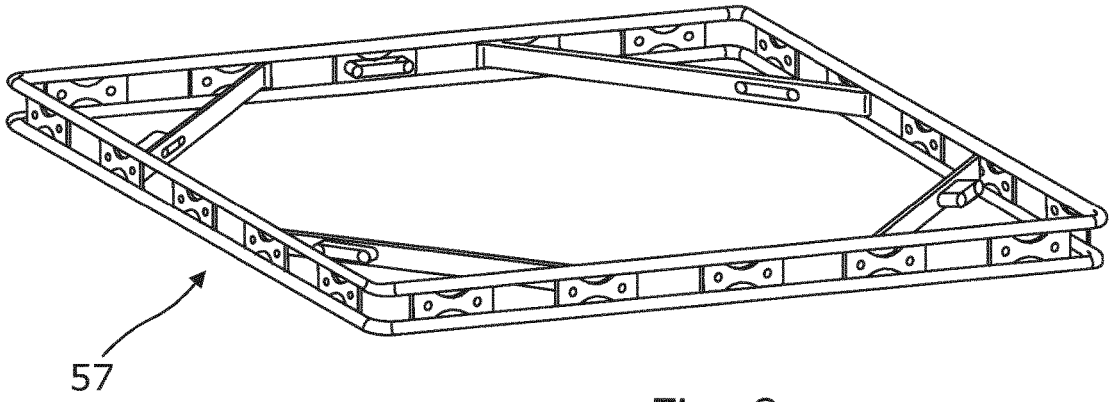

The maritime chute is in one end connected with a bottom frame 57 as shown in FIG. 8. The bottom frame 57 is also connected with an inflatable life raft (not shown) and is configured to assist in deploying the inflatable life raft and the maritime chute.

Figure 9:
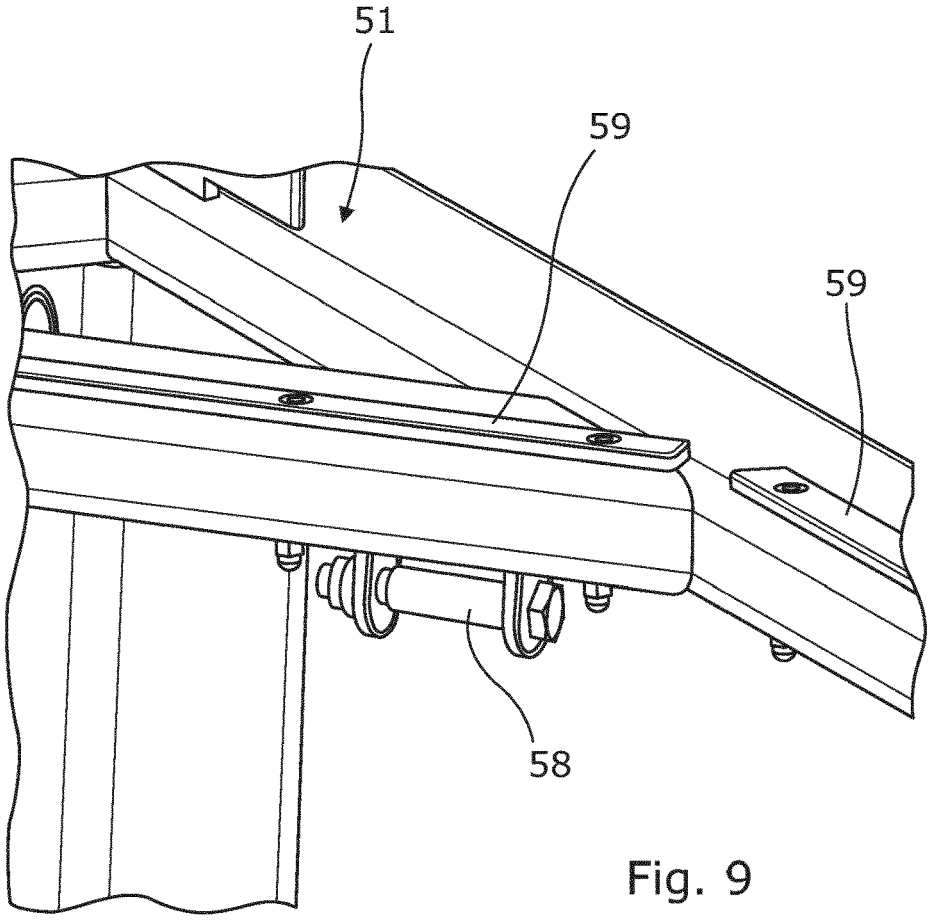

In FIG. 9 a part of the frame 51 is shown. A number of mounting members 58 are arranged in connection with the frame 51. The outer lines (not shown) are configured to be mounted in the mounting members 58 so that the maritime chute is securely fastened to the frame. In addition, on top of the frame 51 flat profiles 59 are arranged. The flat profiles are configured to maintain the outer liner in relation to the frame by introducing the outer liner between the frame 51 and the flat profiles 59 and subsequently fastening the flat profiles 59 to the frame 51.

Figure 10:
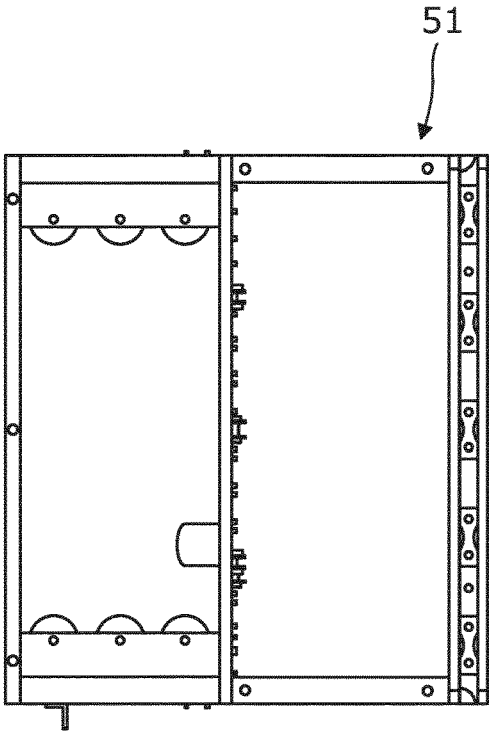
Figure 11:
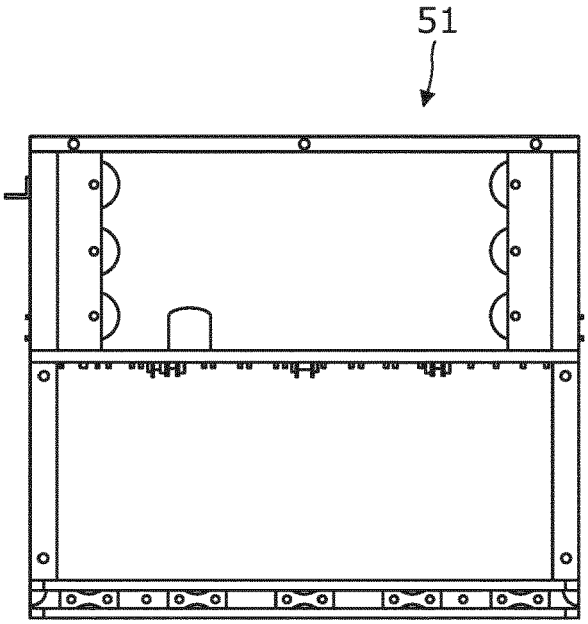

FIG. 10 shows the chute dispenser 50 in a storage position and in FIG. 11 the chute dispenser 50 is moved into an evacuation position wherein the maritime chute is ready to be deployed. In FIG. 10 the chute dispenser 50 is adapted to be within the outer perimeter of the vessel or offshore facility and in FIG. 11 the chute dispenser 50 has been moved to a position outside the outer perimeter enabling the maritime chute to be deployed in a substantially vertical direction.

In the present embodiment one chute dispenser 50 is shown. A plurality of chute dispensers may be arranged adjacent to each other depending on the intended capacity of the maritime evacuation system.

Figure 12:
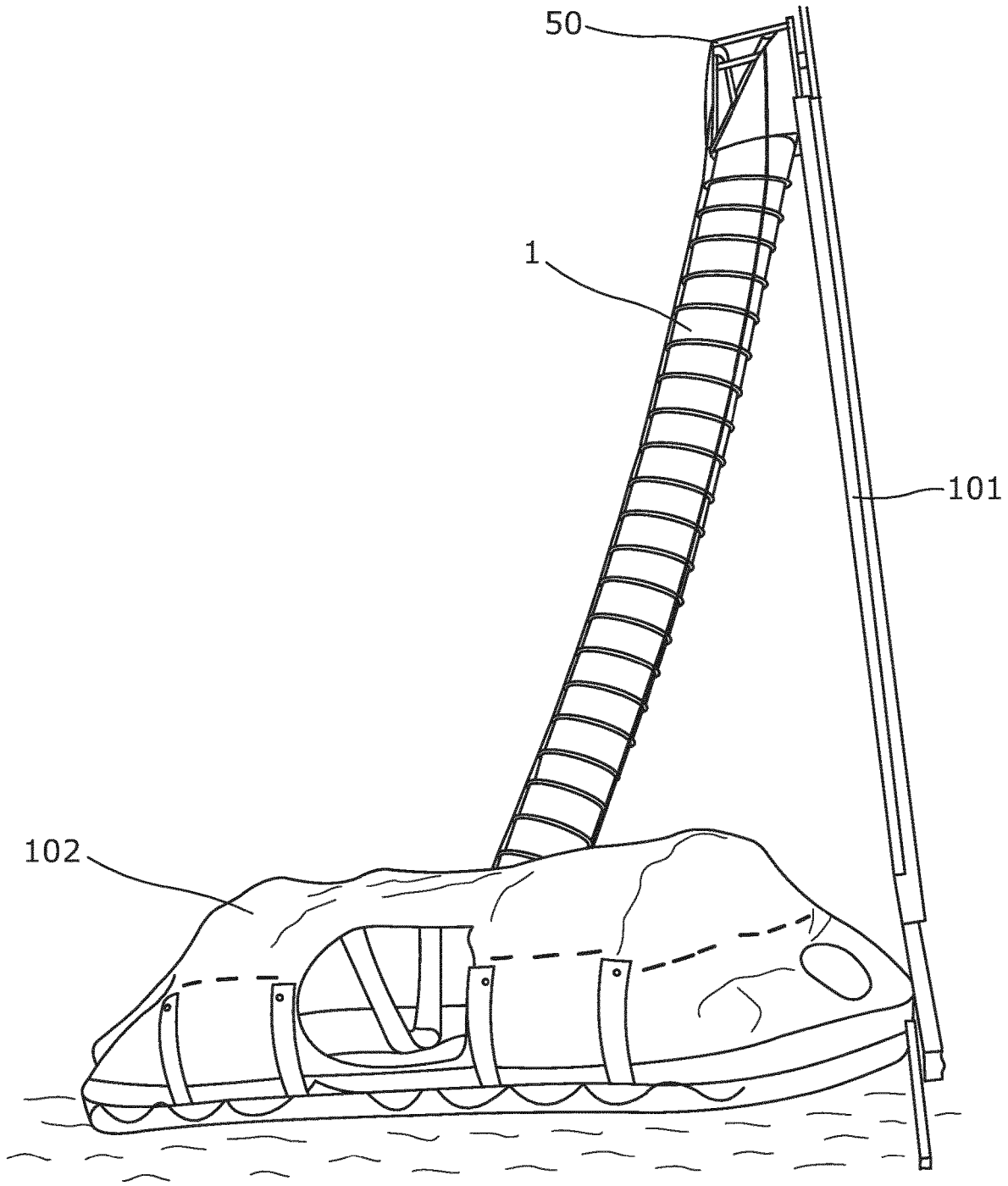
FIG. 12 shows a maritime evacuation system.

In FIG. 12 a maritime evacuation system is shown. The maritime evacuation system comprises a vessel 101 or offshore facility, a maritime chute 1 as described above and an inflatable life raft 102 or inflatable survival craft or rescue boat.

A method for assembling the maritime chute 1 comprises providing an inlet section, providing a first section AB comprising a first upper AB end and second lower AB end, connecting the first upper AB end to the inlet section, providing a second section BA comprising a first upper BA end and a second lower BA end, aligning the second connection means of the second lower AB end of the first section AB with the third connection means of the first upper BA end of the second section, connecting the second connection means with the third connection means, providing an additional first section AB, aligning the fourth connection means of the second lower BA end of the second section BA with the first connection means of the first upper AB end of the additional first section AB, connecting the fourth connection means with the first connection means, providing an additional second section BA, aligning the second connection means of the second lower AB end of the additional first section AB with the third connection means of the first upper BA end of the additional second section, connecting the second connection means with the third connection means.

The steps of providing additional first sections and second sections, aligning the connection means of the sections and connecting the connection means with each other are continued until a predetermined height of the maritime chute is reached.

In addition, the steps of aligning may be performed by arranging indications opposite each other.

Although the maritime chute has been described in the above in connection with preferred embodiments of the claimed invention, it will be evident for a person skilled in the art that several modifications are conceivable without departing from the claimed invention as defined by the following claims.

The invention claimed is:

1. A maritime chute for maritime evacuation from a vessel to a floatable unit, the maritime chute being configured to substantially vertical descend, the maritime chute comprising an inlet section, a plurality of first sections, each first section comprising a first upper end having a first connection means and second lower end having a second connection means, and a plurality of second sections, each second section comprising a first upper end having a third connection means and a second lower end having a fourth connection means, the first connection means being configured to be arranged opposite to and to interact with the fourth connection means for providing a first releasable connection, and the second connection means being configured to be arranged opposite to and to interact with the third connection means for providing a second releasable connection, the sections when connected define an evacuation path to lead a person down through the maritime chute during a descent;

wherein the first connection means are different from the second connection means so that a first section is not able to be connected with another first section; and wherein the third connection means are different from the fourth connection means so that a second section is not able to be connected with another second section.

2. The maritime chute according to claim 1, the plurality of first sections being different to the plurality of second sections.

3. The maritime chute according to claim 1, wherein:

the first upper end of each first section comprises a first indication and the second lower end of each first section comprises a second indication, the first upper end of each second section comprises a third indication and the second lower end of each second section comprises a fourth indication, the first indication being configured to be arranged opposite the fourth indication for ensuring that the first upper end of the first section is positioned correctly in relation to the second lower end of the second section before connecting the first connection means with the fourth connection means, and the second indication is configured to be arranged opposite the third indication for ensuring that the first lower end of the first section is positioned correctly in relation to the second upper end of the second section before connecting the second connection means with the third connection means.

4. The maritime chute according to claim 1, wherein two adjacent connection means are configured to interact with each other after being positioned in relation to each other.

5. The maritime chute according to claim 1, wherein the evacuation path is a helix slide extending continuously down through the sections.

6. The maritime chute according to claim 5, wherein each first section has a first helix slide part and each second section has a second helix slide part.

7. The maritime chute according to claim 6, wherein the first helix slide part has a first helix part end and a second helix part end, and the second helix slide part has third helix part end and a fourth helix part end.

8. The maritime chute according to claim 7, wherein the first helix slide part end is configured to be connected with the fourth helix slide part end and the second helix slide part end is configured to be connected with the third helix slide part end, and vice versa, for providing a continuously extending helix slide down through the first and second sections.

9. The maritime chute according to claim 5, wherein the first helix slide part is overlapping with the second helix slide part and vice versa so that a smooth slide path is obtained.

10. The maritime chute according to claim 5, wherein each helix slide part is a double layer configuration.

11. A maritime evacuation system comprising a vessel or offshore facility, a maritime chute according to claim 1, and an inflatable life raft or inflatable survival craft or rescue boat.

12. A method for assembling a maritime chute according to claim 1, comprising providing an inlet section, providing a first section comprising a first upper end and second lower end, connecting the first upper end to the inlet section, providing a second section comprising a first upper end and a second lower end, aligning the second connection means of the second lower end of the first section with the third connection means of the first upper end of the second section, connecting the second connection means with the third connection means, providing an additional first section, aligning the fourth connection means of the second lower end of the second section with the first connection means of the first upper end of the additional first section, connecting the fourth connection means with the first connection means, providing an additional second section, aligning the second connection means of the second lower end of the additional first section with the third connection means of the first upper end of the additional second section, and connecting the second connection means with the third connection means.

13. The method according to claim 12, wherein the steps of providing additional first sections and second sections, aligning the connection means of the sections and connecting the connection means with each other are continued until a predetermined height of the maritime chute is reached.

14. The method according to claim 12, wherein the steps of aligning are performed by arranging indications opposite each other.

15. A maritime chute according to claim 1 wherein the first connection means is different compared to the third connection means, and the second connection means is different compared to the fourth connection means, so that the first connection means interacts with the fourth connection means only, and the second connection means interact with the third connection means only.

16. A maritime chute for maritime evacuation from a vessel to a floatable unit, the maritime chute being configured to substantially vertical descend, the maritime chute comprising:

an inlet section, a plurality of first sections, each first section comprising a first upper end having a first connection means and second lower end having a second connection means, and a plurality of second sections, each second section comprising a first upper end having a third connection means and a second lower end having a fourth connection means, the first connection means being configured to be arranged opposite to and to interact with the fourth connection means for providing a first releasable connection, and the second connection means being configured to be arranged opposite to and to interact with the third connection means for providing a second releasable connection, the sections when connected define an evacuation path to lead a person down through the maritime chute during a descent, wherein each connection means comprises a plurality of tunnel segments, each tunnel segment being arranged with a distance to an adjacent tunnel segment thereby providing a space between them wherein a tunnel segment of another connection means is configured to be inserted so that all tunnel segments of two adjacent connection means together define a continuously extending tunnel in which a locking member is arranged for locking two adjacent connection means to each other.

17. The maritime chute according to claim 16, wherein the tunnel segments of two adjacent connection means are arranged so that they only can be inserted in relation to each other when two adjacent sections are aligned in relation to each other.

18. The maritime chute according to claim 16, wherein the locking member is circular being substantially the same size as the outer circumferences of the first and second sections.

19. The maritime chute according to claim 18, wherein the locking member comprises two or more ring parts, each end of the ring parts comprises locking means so that two ring parts can be locked to each other providing a continuously extending ring.

* * * * *